US009834870B2

(12) United States Patent
Egawa et al.

(10) Patent No.: US 9,834,870 B2
(45) Date of Patent: Dec. 5, 2017

(54) INDUSTRIAL TWO-LAYER FABRIC

(71) Applicant: NIPPON FILCON CO., LTD., Inagi-shi, Tokyo (JP)

(72) Inventors: Toru Egawa, Fuji (JP); Fumihito Takahashi, Fuji (JP)

(73) Assignee: NIPPON FILCON CO., LTD., Inagi-shi, Tokyo (JP)

( * ) Notice: Subject to any disclaimer, the term of this patent is extended or adjusted under 35 U.S.C. 154(b) by 449 days.

(21) Appl. No.: 14/422,614

(22) PCT Filed: Dec. 25, 2013

(86) PCT No.: PCT/JP2013/084594
§ 371 (c)(1),
(2) Date: Feb. 19, 2015

(87) PCT Pub. No.: WO2014/104065
PCT Pub. Date: Jul. 3, 2014

(65) Prior Publication Data

US 2015/0203994 A1 Jul. 23, 2015

(30) Foreign Application Priority Data

Dec. 27, 2012 (JP) ..... 2012-283900

(51) Int. Cl.
*D21F 1/00* (2006.01)
*D03D 3/04* (2006.01)
(Continued)

(52) U.S. Cl.
CPC ..... *D03D 1/00* (2013.01); *D03D 11/00* (2013.01); *D21F 1/0045* (2013.01);
(Continued)

(58) Field of Classification Search
CPC ..... D21F 1/0045; D21F 1/0054; D21F 7/10; D03D 11/00; D03D 1/0094;
(Continued)

(56) References Cited

U.S. PATENT DOCUMENTS 7,108,019 B2 9/2006 Nagura et al.
7,357,157 B2 * 4/2008 Ueda ..... D21F 1/0036 139/383 A
(Continued)

FOREIGN PATENT DOCUMENTS

JP 2000-290854 A 10/2000
JP 2000-290855 A 10/2000
(Continued)

OTHER PUBLICATIONS

English translation of International Search Report issued in International Application No. PCT/JP2013/084594 dated Apr. 15, 2014 (2 pages).

*Primary Examiner* — Bobby Muromoto, Jr.
(74) *Attorney, Agent, or Firm* — Flynn, Thiel, Boutell & Tanis, P.C.

(57) ABSTRACT

An industrial two-layer fabric of the contact-yarn binding type without independent binding yarns, at both ends. The upper surface side warp serving as the warp fabric yarn-contact binding yarn is not woven into the upper surface side weft at one or more points of a complete structure, and extends toward the lower surface side instead and is woven into the lower surface side weft at the lower surface side, and then, extends toward the upper surface sides to be woven into other upper surface side weft, while, the lower surface side warp is not woven into the lower surface side weft at a point where the upper surface side warp serving as the warp fabric yarn-contact binding yarn is woven into the lower surface side weft at the lower surface side, and extends toward the upper surface side instead to be woven into the
(Continued)

upper surface side weft which is not woven into the upper surface side warp, at the upper surface side, and then extends toward the lower surface side to be woven into other lower surface side weft. The industrial two-layer fabric forms a joint loop by at least one end portion of the warp being turned back at both end portions in its longitudinal direction, and at least a longitudinal yarn in a complete structure includes at least one warp which forms a pair arranged to be opposite to the warp which is turned back for forming the joint loop, and, in a longitudinal structure, the number of knuckles of one of the warps forming the pair is the same as that of the other of the warps forming the pair and distances between said adjacent knuckles are substantially the same.

3 Claims, 8 Drawing Sheets

(51) Int. Cl.
*D03D 11/00* (2006.01)
*D03D 1/00* (2006.01)

(52) U.S. Cl.
CPC .... *D21F 1/0054* (2013.01); *D03D 2700/0111* (2013.01); *D03D 2700/0155* (2013.01); *Y10T 442/3179* (2015.04)

(58) Field of Classification Search
CPC ..... Y10S 162/903; Y10S 162/90; Y10S 162/902; Y10S 162/904; Y10S 2413/00; Y10T 428/19; B32B 413/00; D10B 2505/00
See application file for complete search history.

(56) References Cited

U.S. PATENT DOCUMENTS 7,381,308 B2 6/2008 Kornett et al.
7,426,943 B2 9/2008 Ueda et al.
7,874,322 B2 * 1/2011 Ueda ..... D21F 1/0045 139/383 A
9,371,602 B2 * 6/2016 Ueda ..... D21F 1/0045
2003/0217782 A1 11/2003 Nagura et al.
2005/0252566 A1 * 11/2005 Kornett ..... D21F 1/0054 139/383 AA
2006/0102244 A1 * 5/2006 Ueda ..... D21F 1/0036 139/383 A
2006/0112999 A1 * 6/2006 Nagura ..... D21F 1/0036 139/383 A
2006/0278295 A1 12/2006 Ueda et al.
2006/0278297 A1 * 12/2006 Ueda ..... D21F 1/0036 139/383 A
2008/0035231 A1 * 2/2008 Hay ..... D21F 1/0045 139/420 B
2008/0196784 A1 * 8/2008 Quigley ..... D21F 1/0045 139/383 A
2010/0032119 A1 * 2/2010 Quigley ..... D21F 1/0045 162/358.2
2010/0119787 A1 * 5/2010 Ueda ..... D21F 1/0036 428/196
2010/0252137 A1 * 10/2010 Ueda ..... D21F 1/0036 139/413
2011/0011485 A1 * 1/2011 Ueda ..... D21F 1/0036 139/383 A
2011/0114278 A1 * 5/2011 Stone ..... D21F 1/0045 162/289
2016/0168765 A1 * 6/2016 Usuki ..... D21F 1/0054 442/239

FOREIGN PATENT DOCUMENTS

JP 2003-96683 A 4/2003
JP 2003-342889 A 12/2003
JP 2006-328585 A 12/2006
JP 2007-537371 A 12/2007
JP 2008-19521 A 1/2008
JP 2009-19282 A 1/2009

* cited by examiner

INDUSTRIAL TWO-LAYER FABRIC

TECHNICAL FIELD OF THE INVENTION

The present invention relates to a structure of a joint loop in an industrial two-layer fabric, in particular, relates to the structure of the joint loop in the industrial two-layer fabric using warp fabric yarn-contact binding yarns.

BACKGROUND ART

Fabrics obtained by weaving warps and wefts have conventionally been used widely as an industrial fabric. They are, for example, used in various fields including papermaking fabrics such as papermaking canvases, non-woven cloth making fabric, sludge hydrating fabric, building material making belts and conveyer belts. In this connection, the applicant developed the two-layer fabric of yarn-contact binding yarn type without independent binding yarns (refer to Patent Publication 1).

The above industrial fabric has to be processed to be in an endless form to be used with being mounted on machines such as a papermaking machine, a hydrating machine, etc.

With respect to method of processing the industrial fabric to be in an endless form, there are many ways. For example, a so-called weave patching method, a method in which each of loops is formed at the both ends of the industrial fabric itself by using its warps to be aligned with each other, and then a joint wire core is introduced into holes of the loops, a method in which the joint wire core is introduced after spiral loops are arranged at both ends of the fabric so as to be aligned with each other, and a method in which the joint wire core is introduced after so-called clipper racing which is a metal hook is mounted on both ends of the fabric are publicly known (refer to Patent Publications 2,3 and 4). These well-known methods are adopted in accordance with an application.

Among the above methods, in the method in which each of loops is formed at the both ends of the industrial fabric itself by using its warps to be aligned with each other, it is possible to freely form the fabric to be an endless form or so as to have ends by introducing the joint wire core or pulling out it. If the fabric can be freely formed to be an endless form or so as to have ends, the fabric can be formed to be an endless form with being wound around a machine after the fabric with ends is wound between rolls of the machined, in a case where the fabric is mounted on the machine, which enables the fabric to be readily and efficiently mounted on the machine.

For example, one end of a new industrial fabric is connected to the one end of after the old industrial fabric which has been used for a long time is formed so as to have ends with being mounted on the machine, and then, the machine can be operated. Based on the above, after the industrial fabric is shifted between the rolls of the machine so as to be wound around the rolls, and then, the fabric is made a round to be entirely wound around the machine, the old industrial fabric is removed and the new industrial fabric can be formed to be an endless from so as to be mounted on the machine.

However, since, in the above joint loop structure used at present, the warps forming the loop at the end portion of the fabric has to be turned back, it is used only in a single layer fabric in the patent documents 2 and 3, or a simple two-layer fabric. It is technically difficult to use said joint loop structure in the industrial two-layer fabric using a novel warp fabric yarn-contact binding yarn.

In case of the method of the patching in a weaving form in which it is impossible to freely form the industrial two-layer fabric in an endless form or the one with ends, so-called a cantilever method is needed. In the cantilever method, the rolls of the machine are supported at its one side, and the industrial fabric is introduced from the one side of the machine in the widthwise direction to be wound around after pillars, etc. which hinders such an introduction at the other side are removed. However, a special structure for removing the fabric is needed for the machine itself in order to carry out the method of the patching in a weaving form under the cantilever method, so that the cost for manufacturing the machine has to be increased. In addition, it is often pointed out that there are technical disadvantage that the machine has to be enlarged, or a wider space for arranging the machine is needed. Further, in case where the industrial fabric which is heavy or very long is used, it becomes difficult to introduce the industrial fabric.

Therefore, it is desired that a method in which the loops are aligned with each other to attain an endless form be adopted in the industrial two-layer fabric using warp fabric yarn-contact binding yarns.

Patent Publication 1: Japanese Patent No. 3925915

Patent Publication 2: Japanese Patent Laid-open Publication 2000-290854

Patent Publication 3: Japanese Patent Laid-open Publication 2000-290855

Patent Publication 4: Japanese Patent Laid-open Publication 2003-96683

DISCLOSURE OF THE INVENTION

Technical Problems to be Solved by Present Invention

The object of the present invention is to form a joint loop structure using warps which form a surface of an industrial two-layer fabric of the contact-yarn binding type without independent binding yarns, at its both ends.

Means to Solve Technical Problems

Since the industrial two-layer fabric of the present invention forms a joint loop structure using warps at its both ends of the contact-yarn binding type without independent binding yarns, it has following technical features.

(1) The industrial two-layer fabric includes at least one upper surface side fabric constituted by upper surface side warps and upper surface side wefts, at least one lower surface side fabric constituted by lower surface side warps and lower surface side wefts, and lower surface side warps constituted by a pair of an upper surface side warp serving as a warp fabric yarn-contact binding yarn and a lower surface side warp serving as a warp fabric yarn-contact binding yarn. The upper surface side warp serving as the warp fabric yarn-contact binding yarn is not woven into the upper surface side weft at one or more points of a complete structure, and extends toward the lower surface side instead and is woven into the lower surface side weft at the lower surface side, and then, extends toward the upper surface sides to be woven into other upper surface side weft, while, the lower surface side warp is not woven into the lower surface side weft at a point where the upper surface side warp serving as the warp fabric yarn-contact binding yarn is woven into the lower surface side weft at the lower surface side, and extends toward the upper surface side instead to be woven into the upper surface side weft which is not woven into the upper surface side warp, at the upper surface side, and then extends toward the lower surface side to be woven into other lower surface side weft. The industrial two-layer fabric forms a joint loop by at least one end portion of the warp being turned back at both end portions in its longitudinal direction, and at least a longitudinal yarn in a complete structure includes at least one warp which forms a pair arranged to be opposite to the warp which is turned back for forming the joint loop, and, in a longitudinal structure, the number of knuckles of one of the warps forming the pair is the same as that of the other of the warps forming the pair and distances between said adjacent knuckles are substantially common.

(2) The warps forming the pair are constituted by the pair of the warp fabric yarn-contact binding yarns and the pair of upper surface side warp and the lower surface side warp.

(3) The warps forming the pair are constituted by the pair of the warp fabric yarn-contact binding yarns, the pair of upper surface side adjacent warps, and the lower surface side adjacent warps.

Effect of the Invention

According to the present invention, a joint loop structure using warps which form a surface of the industrial two-layer fabric of the contact-yarn binding type without independent binding yarns can be formed at its both ends.

BRIEF EXPLANATION OF DRAWINGS

FIG. 2(*a*) is a cross section view taken along the warp fabric yarn-contact binding yarn 4Ub, 4Lb in FIG. 1. FIG. 2(*b*) is a cross section view taken along the upper surface side warp 5U and the lower surface side warp 5L in FIG. 1.

FIG. 4(*a*) is a cross section view taken along the warp fabric yarn-contact binding yarn 4Ub, 4Lb in FIG. 3. FIG. 4(*b*) is a cross section view taken along the upper surface side warp 5U and the lower surface side warp 5L in FIG. 3.

FIG. 6(*a*) is a cross section view taken along the warp fabric yarn-contact binding yarn 4Ub, 4Lb in FIG. 5. FIG. 6(*b*) is a cross section view taken along the upper surface side warp 5U and the lower surface side warp 5L in FIG. 5.

FIG. 8(*a*) is a cross section view taken along the warp fabric yarn-contact binding yarn 1Ub, 1Lb in FIG. 7. FIG. 8(*b*) is a cross section view taken along the upper surface side warp 2U and the lower surface side warp 2L in FIG. 7.

FIG. 13(*a*) is a cross section view taken along the warp fabric yarn-contact binding yarn 3Ub, 3Lb in FIG. 12. FIG. 13(*b*) is a cross section view taken along the upper surface side warp 4U and the lower surface side warp 4L in FIG. 12.

FIG. 15(*a*) is a cross section view taken along the warp fabric yarn-contact binding yarn 1Ub, 1Lb in FIG. 14. FIG. 15(*b*) is a cross section view taken along the upper surface side warp 2U and the lower surface side warp 2L in FIG. 14.

DETAILED DESCRIPTION OF THE INVENTION

Figure 1:
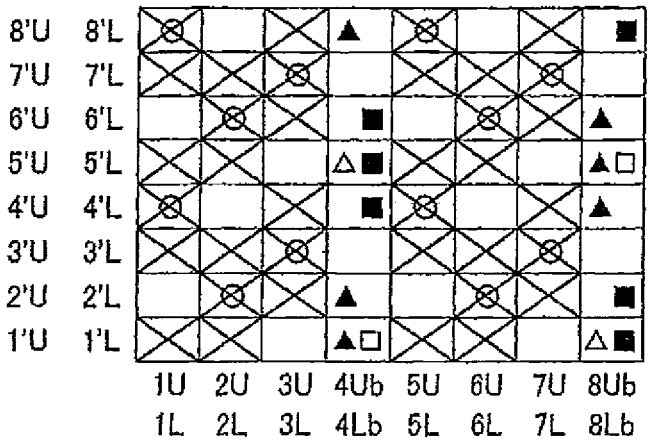
FIG. 1 is a design view showing a complete structure of the first embodiment according to the present invention.

Now, the structure and the effect of the two-layer fabric of the present invention will be described below. Embodiments of the two-layer fabric of the present invention will be described thereafter with reference to the drawings.

The two-layer fabric of the present invention is the one which includes at least one upper surface side fabric constituted by upper surface side warps and upper surface side wefts, at least one lower surface side fabric constituted by lower surface side warps and lower surface side wefts, and binding weft yarns each of which binds the upper surface side fabric and the lower surface side fabric.

The warp fabric yarn-contact binding yarn in the present invention is not just a yarn which functions to bind the upper surface side fabric and the lower surface side fabric, and is defined to be a yarn which functions not only to bind the upper surface side fabric and the lower surface side fabric, but also to cooperate with the upper surface side warp to form the surface structure on the upper surface side fabric.

In the industrial two-layer fabric of the present invention, the upper surface side warp serving as the warp fabric yarn-contact binding yarn is not woven into the upper surface side weft at one or more points of a complete structure, and extends toward the lower surface side instead and is woven into the lower surface side weft at the lower surface side, and then, extends toward the upper surface sides to be woven into other upper surface side weft, while, the lower surface side warp is not woven into the lower surface side weft at a point where the upper surface side warp serving as the warp fabric yarn-contact binding yarn is woven into the lower surface side weft at the lower surface side, and extends toward the upper surface side instead to be woven into the upper surface side weft which is not woven into the upper surface side warp, at the upper surface side, and then extends toward the lower surface side to be woven into other lower surface side weft.

By adopting such a structure, the upper surface side structure and the lower surface side structure can be prevented from being collapsed, and good wire mark properties can be obtained. In addition, since the yarn which functions as the binding yarn is a contact-yarn constituting the fabric structure and is a warp which is constantly tensioned during its use, as compared with the binding yarn of the weft, the very strong binding force which adheres the upper surface side fabric to the lower surface side fabric is always applied, so that a good adhesive properties are obtained. Therefore, the binding force can be prevented from being weakened due to the fact that the binding yarn is rubbed between the upper and lower surface side fabrics to cause an inner wear, or the clearance between the upper and lower surface side fabrics can be prevented from being generated, or the upper and lower surface side fabrics can be prevented from being separated. In addition, the upper and lower surface side fabrics are bound by the upper and lower warp fabric yarn-contact binding yarns, the adhesive properties can be further improved.

Further, in the industrial two-layer fabric of the present invention, a joint loop is formed by turning back at least a portion of the warp at the both ends in the longitudinal direction of the fabric which corresponds to the direction in which the belt advances. Since the longitudinal yarn in the complete structure forms the joint loop, the turned back warp and the warp opposite to the turned back warp form a pair. The number of the knuckles of one of the warps forming the pair is the same as that of the other of the warps forming the pair, in the longitudinal structure, and the shapes of the knuckles are substantially same, and the distance between the knuckles are substantially same.

In this connection, the phrase of "shapes of the knuckles are substantially same" excludes a case where the shapes of the knuckles are completely same in a physical sense. For example, in a case where one of the warps forming a pair passes over three upper surface side wefts to pass below one lower surface side weft, while the other of the warps passes over three upper surface side wefts to pass below one lower surface side weft, this situation corresponds to "shapes of the knuckles are substantially same". The phrase of "a distance between the knuckles are substantially same" also excludes a case where the distance between the knuckles are completely same in a physical sense. By making the knuckles of the warps forming the pair substantially same, the intertwining portions between the warp and the weft can be fallen, so that the mesh surface at the edge portion of the loop becomes neat.

In this connection, no limitation is put on the density related to the number of yarns relative to the upper surface side fabric, while the density of the lower surface side can be set to be the same as that of the upper surface side fabric, or ½, ⅔, for example, of the density of upper surface side fabric.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As the upper surface side warps, lower surface side warps, and upper surface side wefts, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Design of a plurality of yarns having a thin diameter brings about improvement in surface property and thinning of the fabric.

Now, the embodiments of the present invention will be described below with reference to the drawings. FIG. 1 is a design view showing a complete structure of a first embodiment of the present invention. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1,2,3 . . . . The upper and lower warps are indicated by the reference number to which U and D are attached, respectively.

The weft is indicated by a reference number such as 1',2',3' . . . . The upper surface side weft and the lower surface side weft are indicated by the reference number to which u and d are attached, respectively, such as 1'*u*, 2'*d*, etc. In addition, the binding weft yarn and the auxiliary weft are indicated by the reference number to which b and f are attached, respectively, such as 1'*u*, 1'*d*, 2'*b*, 2'*f*, etc. The warp serving as the binding yarn is indicated by adding b, 1Ub, 2Lb, for instance.

In each of the design views, a symbol "×" indicates that the upper surface side warp is arranged above the upper surface side weft or the auxiliary weft, and a symbol "○" indicates that the lower surface side warp is arranged below the lower surface side weft. A solid triangle symbol "▲" indicates that the lower surface side warp serving as the binding weft yarn is arranged above the upper surface side weft. A triangle symbol "Δ" indicates that the upper surface side warp serving as the warp fabric yarn-contact binding yarn is arranged below the lower surface side weft. A solid square symbol "■" indicates that the lower surface side warp serving as the warp fabric yarn-contact binding yarn is arranged above the upper surface side weft. A square symbol "□" indicates that the lower surface side warp serving as the warp fabric yarn-contact binding yarn is arranged below the lower surface side weft.

First Embodiment

Figure 2:
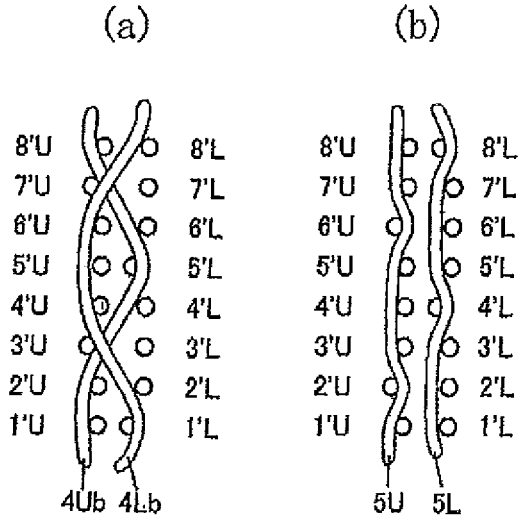
FIG. 2 is a cross section view taken along warp in FIG. 1.

FIGS. 1 and 2 are a design view and a cross section view showing an industrial two-layer fabric according to the first embodiment, respectively.

As shown in FIG. 1, the two-layer fabric of the first embodiment includes upper surface side warps (1U,2U,3U, 5U,6U,7U), lower surface side warps (1L,2L,3L,5L,6L,7L), upper surface side warps 4Ub, 8Ub each serving as a warp fabric yarn-contact binding yarn, and lower surface side warps 4Lb, 8Lb each serving as a warp fabric yarn-contact binding yarn to form eight shafts. A ratio of the upper surface side wefts (1'U,2'U . . . ) to the lower surface side wefts (1'L, 2'L . . . ) is 1/1.

In this embodiment, as shown in FIG. 2(*a*), the upper surface side warp (4Ub) serving as the warp fabric yarn-contact binding yarn is not woven into the upper surface side weft at one point (4'U, 5'U,6'U) of a complete structure into which an upper surface side warp would be essentially woven, and extends toward the lower surface side instead and is woven into the lower surface side weft (5'L) at the lower surface side, and then, extends toward the upper surface side to be woven into other upper surface side weft. On the other hand, the lower surface side warp (4Lb) is not woven into the lower surface side weft (5'L) at the point where the upper surface side warp (4Ub) serving as the warp fabric yarn-contact binding yarn is woven into the lower surface side weft (5'L) at the lower surface side, and extends toward the upper surface side instead to be woven into the upper surface side wefts (4'U, 5'U,6'U) into which the upper surface side warp (4Ub) is not woven into, at the upper surface side, and then extends toward the lower surface side to be woven into other lower surface side weft.

In addition, as shown in FIG. 2(*b*), the upper surface side warp (5U) is woven into the upper surface side wefts (1'U, 3'U, 4'U, 5'U, 7'U, 8'U) at two points on the upper surface side, while the lower surface side warp (5L) is woven into the lower surface side wefts (4'L, 8'L) at two points on the lower surface side.

In this embodiment, a joint loop (not shown) is formed by at least one end portion of the warp being turned back at both end portions in its longitudinal direction. In the industrial two-layer fabric of this first embodiment, the warps forming a pair are constituted by the upper surface side warp and the lower surface side warp, and the warp fabric yarn-contact binding yarns.

Further, since a longitudinal yarn in the complete structure forms the joint loop, the number of the knuckles of the turned back warp is the same as those of the warp opposite to the turned back warp to form a pair, and distances between the knuckles of the turned back warp are substantially the same as those of the warp opposite to the turned back warp to form a pair, in a longitudinal structure.

By adopting such a structure, the joint loop using the warp can be formed at the both end portions of the industrial two-layer fabric of the contact-yarn binding ※ type at which the conventional joint loop could not be formed.

Second Embodiment

Figure 3:
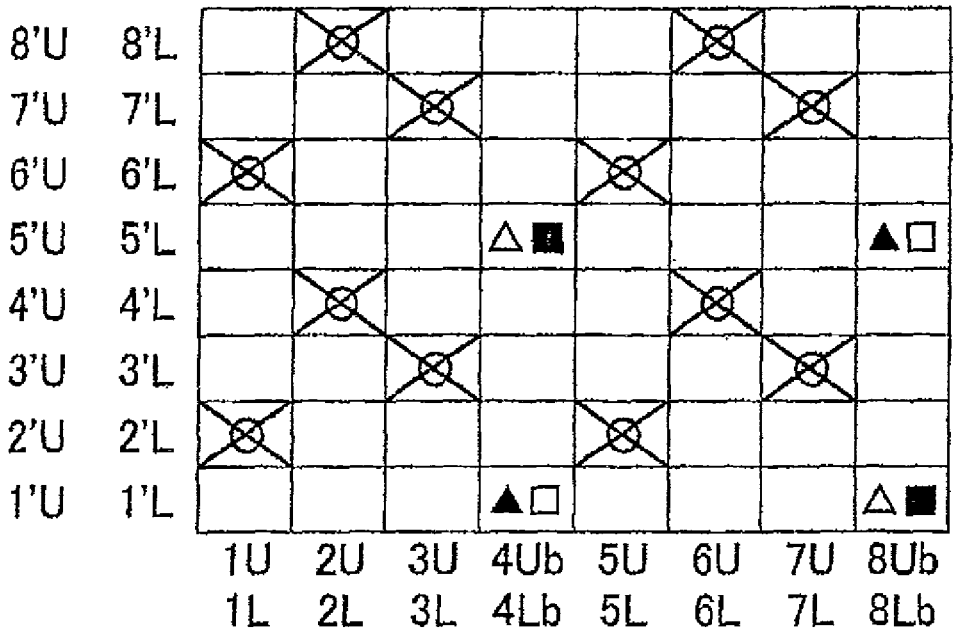
FIG. 3 is a design view showing a complete structure of the second embodiment according to the present invention.
Figure 4:
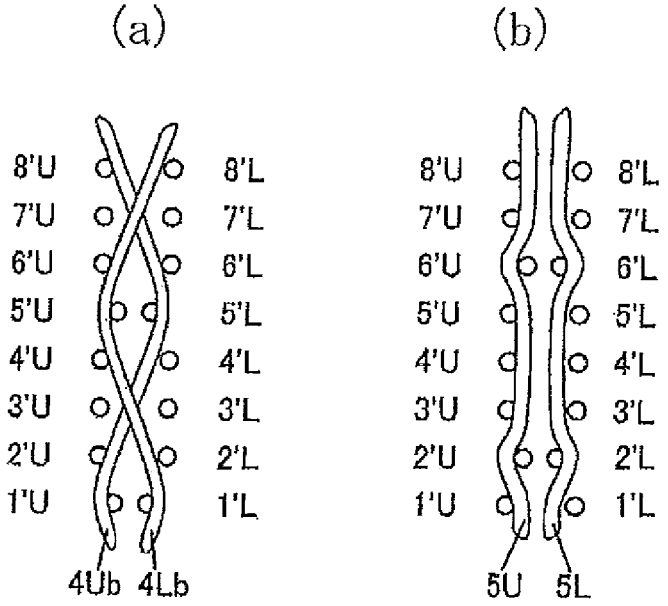
FIG. 4 is a cross section view taken along warp in FIG. 3.

FIGS. 3 and 4 are a design view and a cross section view showing an industrial two-layer fabric according to the second embodiment, respectively.

As shown in FIG. 3, the two-layer fabric of the second embodiment includes upper surface side warps (1U,2U,3U, 5U,6U,7U), lower surface side warps (1L,2L,3L,5L,6L,7L), upper surface side warps 4Ub, 8Ub each serving as a warp fabric yarn-contact binding yarn, and lower surface side warps 4Lb, 8Lb each serving as a warp fabric yarn-contact binding yarn to form eight shafts. A ratio of the upper surface side wefts (1'U,2'U . . . ) to the lower surface side wefts (1'L, 2'L . . . ) is 1/1.

In this embodiment, as shown in FIG. 4(*a*), the upper surface side warp (4Ub) serving as the warp fabric yarn-contact binding yarn is not woven into the upper surface side weft at one point (5'U) of a complete structure into which an upper surface side warp would be essentially woven, and extends toward the lower surface side instead and is woven into the lower surface side weft (5'L) at the lower surface side, and then, extends toward the upper surface side to be woven into other upper surface side weft. On the other hand, the lower surface side warp (4Lb) is not woven into the lower surface side weft (5'L) at the point where the upper surface side warp (4Ub) serving as the warp fabric yarn-contact binding yarn is woven into the lower surface side weft (5'L) at the lower surface side, and extends toward the upper surface side instead to be woven into the upper surface side wefts (5'U) into which the upper surface side warp (4Ub) is not woven into, at the upper surface side, and then extends toward the lower surface side to be woven into other lower surface side weft.

In addition, as shown in FIG. 4(*b*), the upper surface side warp (5U) is woven into the upper surface side wefts (2'U, 6'U) at two points on the upper surface side, while the lower surface side warp (5L) is woven into the lower surface side wefts (2'L, 6'L) at two points on the lower surface side.

In this embodiment, a joint loop (not shown) is formed by at least one end portion of the warp being turned back at both end portions in its longitudinal direction. In the industrial two-layer fabric of this second embodiment, the warps forming a pair are constituted by the upper surface side warp and the lower surface side warp, and the warp fabric yarn-contact binding yarns.

Further, since a longitudinal yarn in the complete structure forms the joint loop, the number of the knuckles of the turned back warp is the same as those of the warp opposite to the turned back warp to form a pair, and distances between the knuckles of the turned back warp are substantially the same as those of the warp opposite to the turned back warp to form a pair, in a longitudinal structure.

By adopting such a structure, the joint loop using the warp can be formed at the both end portions of the industrial two-layer fabric of the contact-yarn binding ※ type at which the conventional joint loop could not be formed.

Third Embodiment

Figure 5:
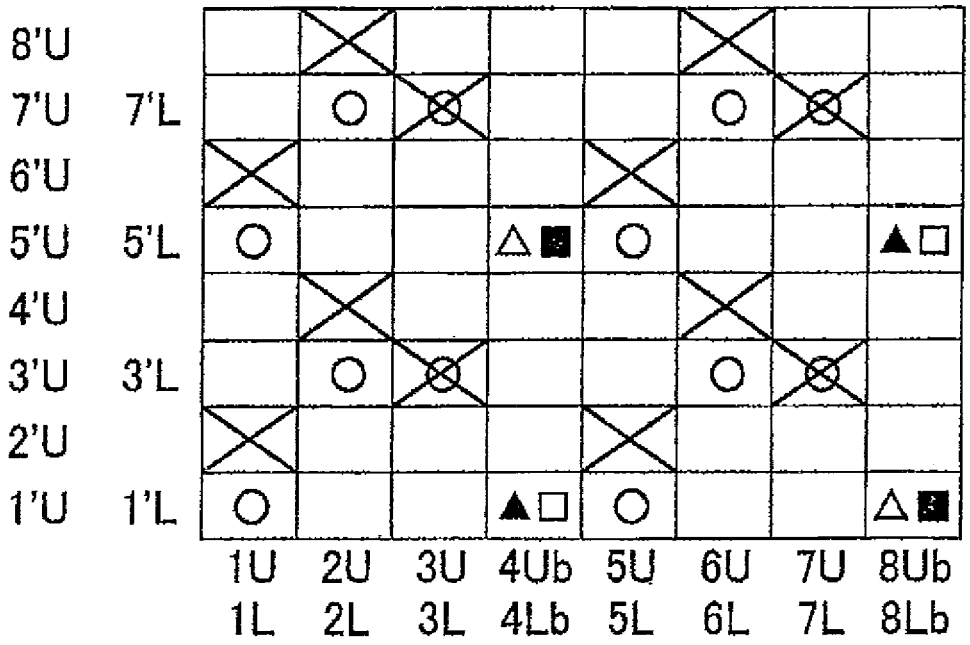
FIG. 5 is a design view showing a complete structure of the third embodiment according to the present invention.
Figure 6:
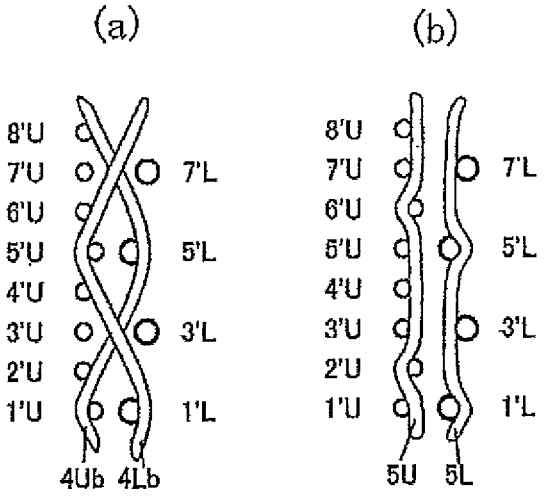
FIG. 6 is a cross section view taken along warp in FIG. 5.

FIGS. 5 and 6 are a design view and a cross section view showing an industrial two-layer fabric according to the third embodiment, respectively.

As shown in FIG. 5, the two-layer fabric of the third embodiment includes upper surface side warps (1U,2U,3U, 5U,6U,7U), lower surface side warps (1L,2L,3L,4L,5L,6L, 7L), upper surface side warps 4Ub, 8Ub each serving as a warp fabric yarn-contact binding yarn, and lower surface side warps 4Lb, 8Lb each serving as a warp fabric yarn-contact binding yarn to form eight shafts. A ratio of the upper surface side wefts (1'U,2'U . . . ) to the lower surface side wefts (1'L, 2'L . . . ) is 2/1.

In this embodiment, as shown in FIG. 6(*a*), the upper surface side warp (4Ub) serving as the warp fabric yarn-contact binding yarn is not woven into the upper surface side weft at one point (5'U) of a complete structure into which an upper surface side warp would be essentially woven, and extends toward the lower surface side instead and is woven into the lower surface side weft (5'L) at the lower surface side, and then, extends toward the upper surface side to be woven into other upper surface side weft. On the other hand, the lower surface side warp (4Lb) is not woven into the lower surface side weft (5'L) at the point where the upper surface side warp (4Ub) serving as the warp fabric yarn-contact binding yarn is woven into the lower surface side weft (5'L) at the lower surface side, and extends toward the upper surface side instead to be woven into the upper surface side wefts (5'U) into which the upper surface side warp (4Ub) is not woven into, at the upper surface side, and then extends toward the lower surface side to be woven into other lower surface side weft.

In addition, as shown in FIG. 6(*b*), the upper surface side warp (5U) is woven into the upper surface side wefts (2'U, 6'U) at two points on the upper surface side, while the lower surface side warp (5L) is woven into the lower surface side wefts (1'L, 5'L) at two points on the lower surface side.

In this embodiment, a joint loop (not shown) is formed by at least one end portion of the warp being turned back at both end portions in its longitudinal direction. In the industrial two-layer fabric of this third embodiment, the warps forming a pair are constituted by the upper surface side warp and the lower surface side warp, and the warp fabric yarn-contact binding yarns.

Further, since a longitudinal yarn in the complete structure forms the joint loop, the number of the knuckles of the turned back warp is the same as those of the warp opposite to the turned back warp to form a pair, and distances between the knuckles of the turned back warp are substantially the same as those of the warp opposite to the turned back warp to form a pair, in a longitudinal structure.

By adopting such a structure, the joint loop using the warp can be formed at the both end portions of the industrial two-layer fabric of the contact-yarn binding type at which the conventional joint loop could not be formed.

Fourth Embodiment

FIGS. 7 to 11 are a design view and a cross section view showing an industrial two-layer fabric according to the fourth embodiment, respectively.

Figure 7:
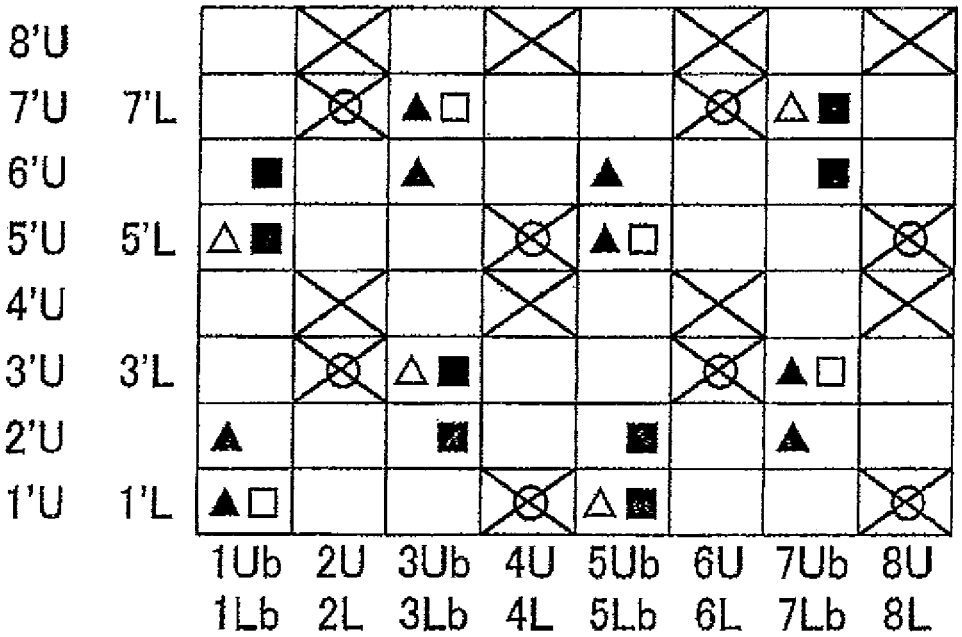
FIG. 7 is a design view showing a complete structure of the fourth embodiment according to the present invention.

As shown in FIG. 7, the two-layer fabric of the first embodiment includes upper surface side warps (2U,4U,6U, 8U), lower surface side warps (2L,4L,6L,8L), upper surface side warps 1Ub,3Ub,5Ub,7Ub each serving as a warp fabric yarn-contact binding yarn, and lower surface side warps 1Lb,3Lb,5Lb,7Lb each serving as a warp fabric yarn-contact binding yarn to form eight shafts. A ratio of the upper surface side wefts (1'U, 2'U . . . ) to the lower surface side wefts (1'L, 2'L . . . ) is 2/1.

Figure 8:
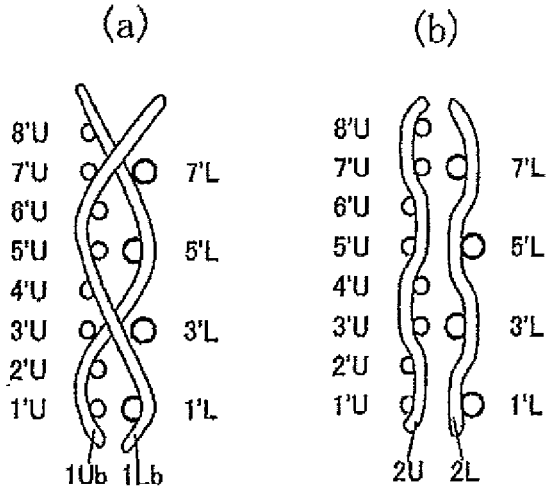
FIG. 8 is a cross section view taken along warp in FIG. 7.

In this embodiment, as shown in FIG. 8(*a*), the upper surface side warp (1Ub) serving as the warp fabric yarn-contact binding yarn is not woven into the upper surface side weft at one point (5'U,6'U) of a complete structure into which an upper surface side warp would be essentially woven, and extends toward the lower surface side instead and is woven into the lower surface side weft (5'L) at the lower surface side, and then, extends toward the upper surface side to be woven into other upper surface side weft. On the other hand, the lower surface side warp (1Lb) is not woven into the lower surface side weft (5'L) at the point where the upper surface side warp (1Ub) serving as the warp fabric yarn-contact binding yarn is woven into the lower surface side weft (5'L) at the lower surface side, and extends toward the upper surface side instead to be woven into the upper surface side wefts (5'U, 6'U) into which the upper surface side warp (1Ub) is not woven into, at the upper surface side, and then extends toward the lower surface side to be woven into other lower surface side weft.

In addition, as shown in FIG. 8(*b*), the upper surface side warp (2U) is woven into the upper surface side wefts (3'U, 4'U,7'U, 8'U) at two points on the upper surface side, while the lower surface side warp (2L) is woven into the lower surface side wefts (3'U, 7'U) at two points on the lower surface side.

Figure 9:
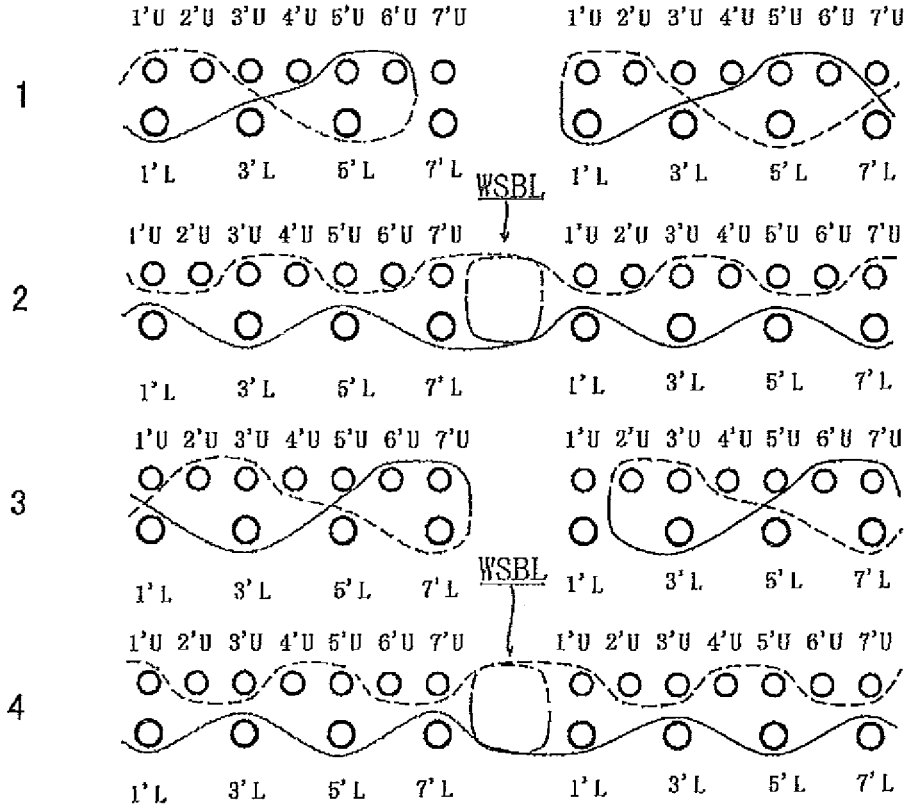
FIG. 9 is a schematic cross sectional view taken along the warp in order to illustrate the joint loop in the industrial two-layer fabric of the fourth embodiment of the present invention, a cross sectional view taken along the warp fabric yarn-contact binding yarn 1Ub in FIG. 7, a cross sectional view taken along the upper surface side warps 2U, 2L, a cross sectional view taken along the warp fabric yarn-contact binding yarn 3Ub, and a cross sectional view taken along the upper surface side warps 4U, 4L, from the above in order.

FIG. 9 is a conceptual cross section of both end portions of the industrial two-layer fabric according to the fourth embodiment. In FIG. 9, from the above, a point 1 of the warp fabric yarn-contact binding yarn by 1Ub and 1Lb, a point 2 of the warp by 2U and 2L, a point 3 of the warp fabric yarn-contact binding yarn by 3Ub and 3Lb, and a point 4 of the warp by 4U and 4L are illustrated, from the above in order.

In the upper point 1, the upper surface side warp 1U serving as warp fabric yarn-contact binding yarn is turned back at the upper surface side weft 6'U to be woven into the lower surface side weft 5'L on the lower surface side into which the lower surface side warp 1Lb serving as warp fabric yarn-contact binding yarn would be woven otherwise, and then, is woven into the upper surface side wefts 2'U,1'U on the upper surface side. As such, the smooth surface can be maintained by turning back the upper surface side warp to be woven into the portion into which the lower surface side warp would be woven.

In the second upper point 2, the upper surface side warp 2U forms the joint loop WSBL and is turned back to be woven into the lower surface side weft 7'L on the lower surface side into which the lower surface side warp 2L would be woven otherwise, and then, is woven into the lower surface side weft 3'L on the lower surface side. On the opposite end portion of the industrial two-layer fabric, the upper surface side warp 2U forms the joint loop WSBL and is turned back to be woven into the lower surface side wefts 3'L,7'L on the lower surface side into which the lower surface side warp 2L would be woven otherwise.

In the third upper point 3, the upper surface side warp 3Ub serving as warp fabric yarn-contact binding yarn and is woven into the upper surface side wefts 6'U, 7'U on the upper surface side to form a stop, and then, is woven into the upper surface side wefts 3'U, 2'U on the upper surface side.

Further, In the fourth upper point 4, the upper surface side warp 4U forms the joint loop WSBL and is turned back to be woven into the lower surface side wefts 5'U, 1'U on the lower surface side into which the lower surface side warp 4L would be woven otherwise.

As described above, since a longitudinal yarn in the complete structure forms the joint loop WSBL, it includes a warp opposite to the turned back warp forming a pair. As can be readily seen, the number of the knuckles in the longitudinal structure of one of the warps forming the pair is the same as that of the other of the warps forming the pair, and distances between the knuckles of one of the warps forming the pair are the same as those of the other of the warps forming the pair.

By adopting such a structure, the joint loop structure using warps on the both end portions of the industrial two-layer fabric of the contact-yarn binding type can be formed which was difficult in the conventional joint loop structure.

Figure 10:
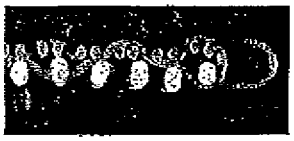
FIG. 10 is a photograph of a cross sectional view taken along the warp fabric yarn-contact binding yarn 3Ub in FIG. 9.

FIG. 10 is a photograph of a longitudinal cross section of the third upper point 3 in FIG. 9. FIG. 10 shows that the stop is formed by the upper surface side warp 3Ub serving as warp fabric yarn-contact binding yarn, and that the lower surface side warp 2L forms the loop at the back.

Figure 11:
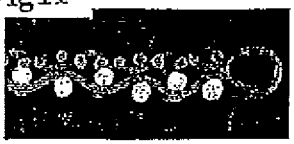
FIG. 11 is a photograph of a cross sectional view taken along the upper surface side warps 4U, 4L.

FIG. 11 is a photograph of a longitudinal cross section of the fourth upper point 4 in FIG. 9. FIG. 11 shows that the upper surface side warp 4U forms the joint loop WSBL to be turned back and is woven into the lower surface side wefts 5'U, 1'U on the lower surface side.

Fifth Embodiment

Figure 12:
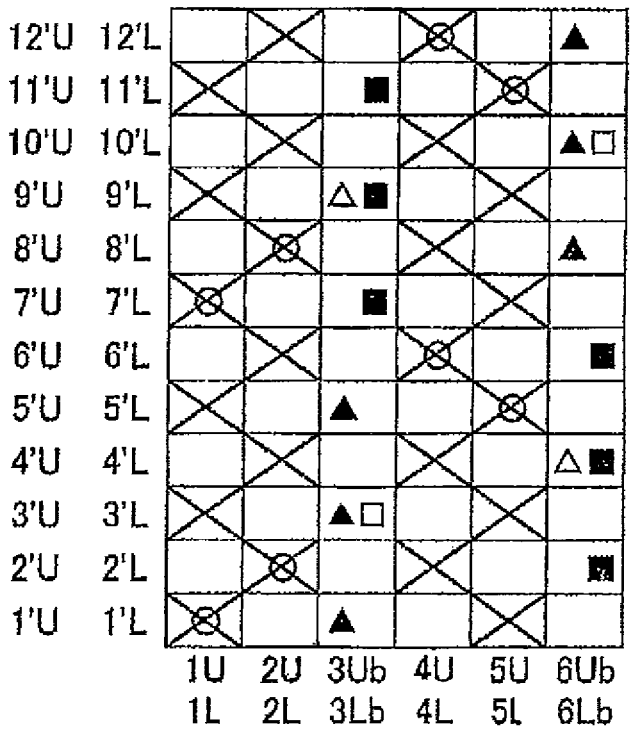
FIG. 12 is a design view showing a complete structure of the fifth embodiment according to the present invention.
Figure 13:
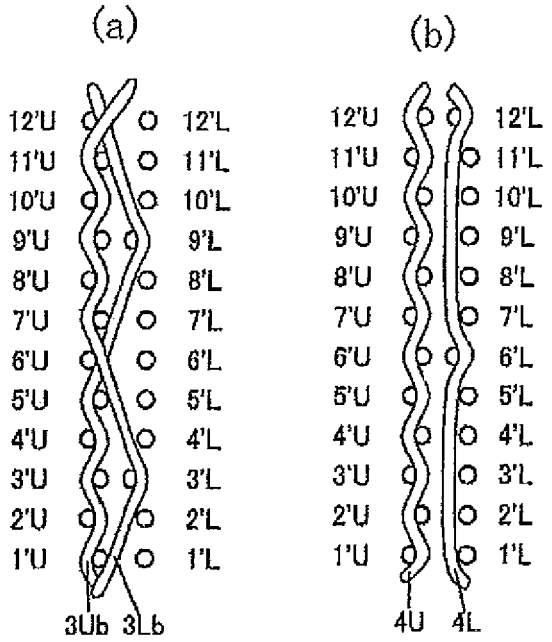
FIG. 13 is a cross section view taken along warp in FIG. 12.

FIGS. 12 and 13 are a design view and a cross section view showing an industrial two-layer fabric according to the fifth embodiment, respectively.

As shown in FIG. 12, the two-layer fabric of the fifth embodiment includes upper surface side warps (1U,2U,4U, 5U), lower surface side warps (1L,2L,4L,5L), upper surface side warps 3Ub, 6Ub each serving as a warp fabric yarn-contact binding yarn, and lower surface side warps 3Lb, 6Lb each serving as a warp fabric yarn-contact binding yarn to form eight shafts. A ratio of the upper surface side wefts (1'U,2'U . . . ) to the lower surface side wefts (1'L, 2'L . . . ) is 1/1.

In this embodiment, as shown in FIG. 13(*a*), the upper surface side warp (3Ub) serving as the warp fabric yarn-contact binding yarn is not woven into the upper surface side weft at one point (7'U, 9'U,11'U) of a complete structure into which an upper surface side warp would be essentially woven, and extends toward the lower surface side instead and is woven into the lower surface side weft (9'L) at the lower surface side, and then, extends toward the upper surface side to be woven into other upper surface side weft. On the other hand, the lower surface side warp (3Lb) is not woven into the lower surface side weft (5'L) at the point where the upper surface side warp (3Ub) serving as the warp fabric yarn-contact binding yarn is woven into the lower surface side weft (51) at the lower surface side, and extends toward the upper surface side instead to be woven into the upper surface side wefts (7'U, 9'U, 11'U) into which the upper surface side warp (3Ub) is not woven into, at the upper surface side, and then extends toward the lower surface side to be woven into other lower surface side weft.

In addition, as shown in FIG. 13(*b*), the upper surface side warp (4U) is woven in a plain weave, while the lower surface side warp (4L) is woven into the lower surface side wefts (6'L, 12'L) at two points on the lower surface side.

In this embodiment, a joint loop (not shown) is formed by at least one end portion of the warp being turned back at both end portions in its longitudinal direction. In the industrial two-layer fabric of this fifth embodiment, the warps forming a pair are constituted by the upper surface side warp and the lower surface side warp, and the warp fabric yarn-contact binding yarns.

Further, since a longitudinal yarn in the complete structure forms the joint loop, the number of the knuckles of the turned back warp is the same as those of the warp opposite to the turned back warp to form a pair, and distances between the knuckles of the turned back warp are substantially the same as those of the warp opposite to the turned back warp to form a pair, in a longitudinal structure.

By adopting such a structure, the joint loop using the warp can be formed at the both end portions of the industrial two-layer fabric of the contact-yarn binding type at which the conventional joint loop could not be formed.

Sixth Embodiment

Figure 14:
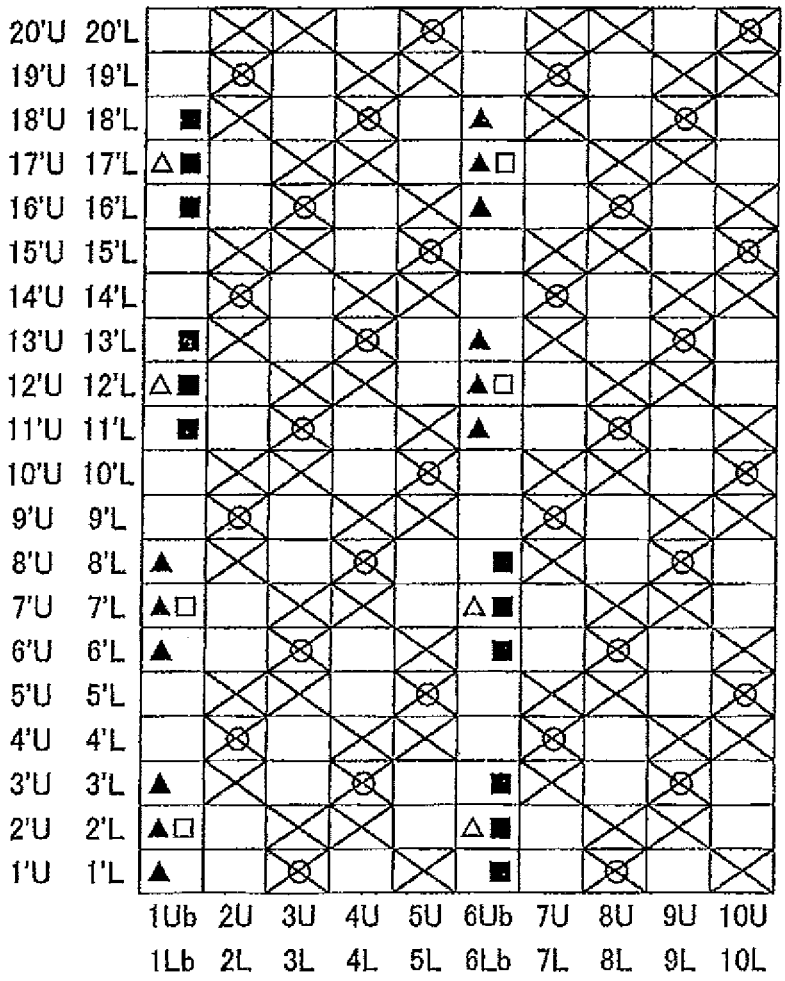
FIG. 14 is a design view showing a complete structure of the sixth embodiment according to the present invention.
Figure 15:
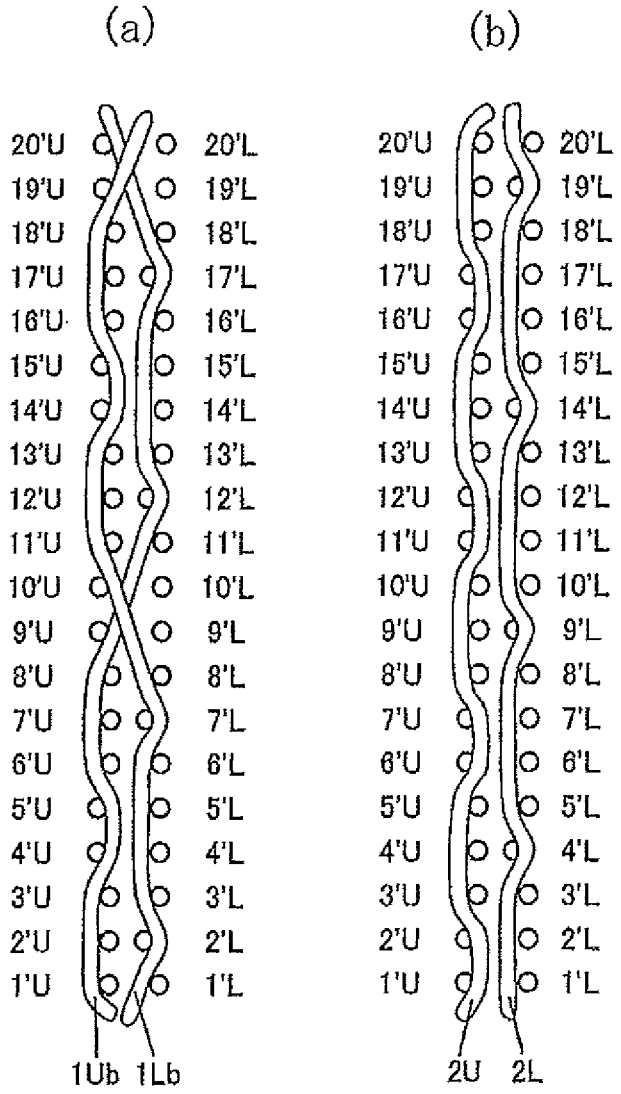
FIG. 15 is a cross section view taken along warp in FIG. 14.

FIGS. 14 and 15 are a design view and a cross section view showing an industrial two-layer fabric according to the sixth embodiment, respectively.

As shown in FIG. 14, the two-layer fabric of the sixth embodiment includes upper surface side warps (1U,2U,3U, 4U,5U,7U,8U,9U,10U), lower surface side warps (1L,2L, 3L,4L,5L,7L,8L,9L,10L), upper surface side warps 1Ub, 6Ub each serving as a warp fabric yarn-contact binding yarn, and lower surface side warps 1Lb, 6Lb each serving as a warp fabric yarn-contact binding yarn to form eight shafts. A ratio of the upper surface side wefts (1'U,2'U . . . ) to the lower surface side wefts (1'L, 2'L . . . ) is 1/1.

In this embodiment, as shown in FIG. 15(*a*), the upper surface side warp (1Ub) serving as the warp fabric yarn-contact binding yarn is not woven into the upper surface side weft at one point (11'U,12'U,13'U,16'U,17'U,18'U) of a complete structure into which an upper surface side warp would be essentially woven, and extends toward the lower surface side instead and is woven into the lower surface side weft (12'L,17'L) at the lower surface side, and then, extends toward the upper surface side to be woven into other upper surface side weft. On the other hand, the lower surface side warp (1Lb) is not woven into the lower surface side weft (5'L) at the point where the upper surface side warp (1Ub) serving as the warp fabric yarn-contact binding yarn is woven into the lower surface side weft (5'L) at the lower surface side, and extends toward the upper surface side instead to be woven into the upper surface side wefts (11'U,12'U,13'U,16'U,17'U,18'U) into which the upper surface side warp (1Ub) is not woven into, at the upper surface side, and then extends toward the lower surface side to be woven into other lower surface side weft.

In addition, as shown in FIG. 15(*b*), the upper surface side warp (2U) is woven at the ratio of 3/2, while the lower surface side warp (2L) is woven at the ratio of 4/1.

In this embodiment, a joint loop (not shown) is formed by at least one end portion of the warp being turned back at both end portions in its longitudinal direction. In the industrial two-layer fabric of this sixth embodiment, the warps forming a pair are constituted by the upper surface side warp and the lower surface side warp, and the warp fabric yarn-contact binding yarns.

Further, since a longitudinal yarn in the complete structure forms the joint loop, the number of the knuckles of the turned back warp is the same as those of the warp opposite to the turned back warp to form a pair; and distances between the knuckles of the turned back warp are substantially the same as those of the warp opposite to the turned back warp to form a pair, in a longitudinal structure.

By adopting such a structure, the joint loop using the warp can be formed at the both end portions of the industrial two-layer fabric of the contact-yarn binding type at which the conventional joint loop could not be formed.

EXPLANATION OF SYMBOLS

Ub Upper surface side warp serving as warp fabric yarn-contact binding yarn
Lb Lower surface side warp serving as warp fabric yarn-contact binding yarn
U Upper surface side warp
L Lower surface side warp
'U Upper surface side weft
'L Lower surface side weft
WSBL Joint Loop

What is claimed is:

1. An industrial two-layer fabric comprises at least one upper surface side fabric constituted by upper surface side warps and upper surface side wefts, at least one lower surface side fabric constituted by lower surface side warps and lower surface side wefts, the lower surface side warps being constituted by a pair of an upper surface side warp serving as a warp fabric yarn-contact binding yarn and a lower surface side warp serving as a warp fabric yarn-contact binding yarn, the upper surface side warp serving as the warp fabric yarn-contact binding yarn is not woven into the upper surface side weft of a complete structure, instead extends toward a lower surface side, is woven into the lower surface weft at the lower surface side and then extends toward the upper surface sides to be woven into another upper surface side weft and the lower surface side warp is not woven into the lower surface side weft at a point where the upper surface side warp serving as the warp fabric yarn-contact binding yarn is woven into the lower surface side weft at the lower surface side and instead extends toward the upper surface side to be woven into the upper surface side weft which is not woven into the upper surface side warp, at the upper surface side, and then extends towards the lower surface side to be woven into another lower surface side weft, wherein the industrial two-layer fabric forms a joint loop by at least one end portion of a wrap being turned back at both end portions in its longitudinal direction, at least a longitudinal yarn in a complete structure includes at least one warp which forms a pair arranged to be opposite to the warp which is turned back for forming the joint loop and, in a longitudinal structure, the number of knuckles of one of the warps forming the pair and distances between adjacent knuckles are substantially the same.

2. The industrial two-layer fabric according to claim 1, wherein the warps forming the pair are constituted by the pair of the warp fabric yarn-contact binding yarns and the pair of upper surface side warp and the lower surface side warp.

3. The industrial two-layer fabric according to claim 1, wherein the warps forming the pair are constituted by the pair of the warp fabric yarn-contact binding yarns, the pair of upper surface side adjacent warps, and the lower surface side adjacent warps.

* * * * *